US010919127B2

(12) United States Patent
Pierednik et al.

(10) Patent No.: US 10,919,127 B2
(45) Date of Patent: Feb. 16, 2021

(54) GRINDING WHEEL

(71) Applicant: Matuschek Messtechnik GmbH, Alsdorf (DE)

(72) Inventors: Christoph Pierednik, Aachen (DE); Tadeusz Ptaszek, Juelich (DE)

(73) Assignee: Matuschek Messtechnik GmbH, Alsdorf (DE)

( * ) Notice: Subject to any disclaimer, the term of this patent is extended or adjusted under 35 U.S.C. 154(b) by 211 days.

(21) Appl. No.: 15/784,276

(22) Filed: Oct. 16, 2017

(65) Prior Publication Data

US 2018/0104794 A1 Apr. 19, 2018

(30) Foreign Application Priority Data

Oct. 17, 2016 (DE) ..... 10 2016 119 746

(51) Int. Cl.
*B24D 11/02* (2006.01)
*B24D 3/06* (2006.01)
(Continued)

(52) U.S. Cl.
CPC ..... *B24D 11/02* (2013.01); *B24B 37/14* (2013.01); *B24B 37/22* (2013.01); *B24B 37/24* (2013.01);
(Continued)

(58) Field of Classification Search
CPC ..... B24D 3/002; B24D 3/004; B24D 3/06; B24D 9/08; B24D 11/02; B24B 37/14; B24B 37/22; B24B 37/24
(Continued)

(56) References Cited

U.S. PATENT DOCUMENTS 2,173,462 A 9/1939 Wagner
2,270,691 A * 1/1942 Schneider ..... B24D 7/02 51/293
(Continued)

FOREIGN PATENT DOCUMENTS

CA 1 181 592 1/1985
CH 350215 12/1960
(Continued)

OTHER PUBLICATIONS

Effgen brochure "Diamond and boron nitride grinding wheels" (Herrstein, Germany, 2008).

*Primary Examiner* — Eileen P Morgan
(74) *Attorney, Agent, or Firm* — Muirhead and Saturnelli, LLC

(57) ABSTRACT

A grinding wheel includes an elastomerically deformable supporting layer, at least a first metallic surface fastened to the elastomerically deformable supporting layer, the metalic surface being an elastically deformable metal foil and includes abrasive particles attached to the at least one metalic surface. The particles may include at least one of: cubic boron nitride or diamonds. The metal foil may have a thickness of less than 1 mm. The abrasive particles may be bonded galvanically on the metallic surface. The abrasive particles may be bonded on the metalic surface in a plurality of areas having regions without abrasive particles therebetween. The metal foil may be adhesively bonded onto the elastomerically deformable supporting layer. The elastomerically deformable supporting layer may be plastic foam. The elastomerically deformable supporting layer may be adhesively bonded onto a metallic supporting body.

22 Claims, 3 Drawing Sheets

(51) Int. Cl.

| | |
|---|---|
| ***B24D 9/08*** | (2006.01) |
| ***B24B 37/14*** | (2012.01) |
| ***B24B 37/22*** | (2012.01) |
| ***B24B 37/24*** | (2012.01) |
| ***B24D 3/00*** | (2006.01) |

(52) U.S. Cl.
CPC ..... *B24D 3/002* (2013.01); *B24D 3/004* (2013.01); *B24D 3/06* (2013.01); *B24D 9/08* (2013.01)

(58) Field of Classification Search
USPC ..... 451/526, 539, 530
See application file for complete search history.

(56) References Cited

U.S. PATENT DOCUMENTS

| | | | | |
|---|---|---|---|---|
| 3,144,737 | A * | 8/1964 | Faas | B24B 13/01 451/538 |
| 3,959,935 | A | 6/1976 | Stoppacher | |
| 4,150,955 | A * | 4/1979 | Samuelson | B24D 13/12 51/295 |
| 4,788,798 | A * | 12/1988 | DeFranco | B24B 13/01 428/212 |
| 6,514,133 | B1 | 2/2003 | Bernard et al. | |
| 1,981,970 | A1 | 6/2010 | Kodani et al. | |
| 7,744,447 | B2 * | 6/2010 | Kodani | B24D 7/06 451/259 |
| 8,366,521 | B2 * | 2/2013 | Kim | B24D 3/28 451/546 |
| 8,845,400 | B2 | 9/2014 | Imai et al. | |
| 9,415,480 | B2 * | 8/2016 | Aoki | B24B 37/245 |
| 2002/0028641 | A1 | 3/2002 | Okubo et al. | |
| 2002/0190737 | A1 | 12/2002 | Maekawa et al. | |
| 2013/0157544 | A1 | 6/2013 | McArdle et al. | |
| 2015/0183076 | A1 * | 7/2015 | Lange | B24B 19/16 451/11 |
| 2015/0239092 | A1 * | 8/2015 | Pierednik | B24B 41/04 451/28 |
| 2015/0290771 | A1 * | 10/2015 | Li | B24D 3/06 51/295 |

FOREIGN PATENT DOCUMENTS

| | | | |
|---|---|---|---|
| DE | 26 01 788 | A1 | 7/1977 |
| DE | 27 32 271 | A1 | 1/1979 |
| DE | 203 03 341 | U1 | 6/2003 |
| DE | 600 00 673 | T2 | 7/2003 |
| DE | 10 2012 215 532 | A1 | 3/2014 |
| DE | 10 2014 203 409 | A1 | 8/2015 |
| EP | 0 050 233 | A2 | 4/1982 |
| GB | 1 458 236 | | 12/1976 |
| WO | WO 00/64630 | | 11/2000 |
| WO | WO 2015/100020 | A1 | 7/2015 |

* cited by examiner

GRINDING WHEEL

TECHNICAL FIELD

The system described herein relates to a grinding wheel and more particularly to a grinding wheel for grinding rigid, metallic welding electrodes for resistance welding.

BACKGROUND

In the case of resistance welding of metal sheets, electric currents with a high current strength are introduced into the metal sheets by way of two electrodes which are pressed against the outer surfaces of the sheets which are to be welded to one another. As a result, the metal of the sheets is melted and forms a welding spot which connects the sheets fixedly to one another, which sheets are pressed against one another. The welding electrodes usually consist of copper or copper alloys. In particular, in the case of aluminum resistance welding, the ideal shape, roughness and the purity of the surface of the welding electrodes are an essential precondition for the production of a welding spot with a high and reproducible quality. The surfaces of the welding electrodes can already be impaired by way of deposits and wear as a result of some welding spots being welded, for example from ten to twenty welding spots, with the result that the welding spots which are produced do not have the required quality. For this reason, welding electrodes are reworked at regular time intervals, with the result that their surfaces have an optimum shape during each welding operation and are free from contaminants. A known method for reworking the surfaces of the welding electrodes is grinding of the welding electrodes.

Document DE 10 2014 203 409 A1 discloses an apparatus and a method for grinding with a grinding wheel which is mounted rotatably by way of a bearing. The machine-side bearing shell of the bearing which mounts the grinding wheel such that it can be rotated about its axis of symmetry is fastened on a bearing carrier in such a way that its plane can be pivoted in all directions. Furthermore, the bearing shell is fastened such that it can be displaced in one direction. The displacement direction of the bearing shell is called the starting direction. The pivotability of the bearing plane in all directions relates to a starting plane which lies perpendicularly with respect to the starting direction. A pivoting action only within a limited angular range of less than 20°, in practice usually less than 10°, has to be made possible in relation to the starting plane, in particular for working welding electrodes. A greater pivoting angle can be selected for other applications. The apparatus includes actuating drives for pivoting and displacing the bearing carrier, and a digital control unit which controls and synchronizes the actuating drives in such a way that the surface of the grinding wheel produces a freely defined area about a stationary reference point which is at a radial spacing from the center point of the grinding wheel. That is to say, the workpiece can be moved toward the reference point parallel to the starting direction, until the end side of the workpiece makes contact with the grinding wheel in the region of the reference point. The control unit controls and synchronizes the actuating drives in such a way that the contact region between the grinding wheel and the end face of the workpiece produces an area which is predetermined in relation to the end face of the workpiece and can be defined freely within the context of the possible freedom of movement of the bearing carrier. In the case of welding electrodes, this area is preferably slightly conical or spherical. Document DE 10 2012 215 532 A1 describes a similar apparatus, in which a mechanical apparatus carries out positive control of the inclination and the position of the grinding wheel, in order to produce a rotationally symmetrical profile on the grinding wheel about a stationary point at a spacing from the center of the wheel. The two documents are made a subject of this disclosure by reference.

The apparatuses and methods described above have proven excellent in practice. However, the grinding wheels may need to be replaced after a relatively short time if impermissibly deep channels or grooves are produced on their surfaces as a result of wear.

A possible way to adress these issues is to use a solid metal disk from the company Günter Effgen GmbH, Herrstein, having two parallel surfaces of which abrasive diamond particles are bonded galvanically. This disk showed that very high service life could be achieved. Firstly, no very great quantities of material are machined during the regrinding of copper electrodes. Moreover, the material to be ground is very soft. Only low mechanical loads of the surface of the grinding wheel are therefore produced overall. A grinding wheel made from metal with diamond particles on the surface can withstand the loads in a virtually unrestricted manner. However, difficulties occur because of the absence of flexibility of the grinding wheel. The grinding operation is very loud, so that the grinding apparatus should be encapsulated. Hard shocks and vibrations loads the bearings and other mechanical components of the grinding apparatus. A further optimization of the grinding wheel with creeping particles appeared to be necessary.

Document U.S. Pat. No. 7,744,447 B2 discloses a grinding wheel with rigid abrasive segments made from metal which are arranged on a metallic carrying plate. The abrasive particles (for example, diamond) are fastened on the rigid metal elements which for their part are fastened via riveted pins on a rigid carrier ring. The carrier ring is fastened on the tool holder via an elastic intermediate layer. The metallic surface which is provided with abrasive particles is very rigid. However the production process for the grinding wheel is relatively complex and expensive.

In document U.S. Pat. No. 8,845,400 B2, a solid steel disk with the abrasive particles is secured to a carrier via a thin rubber layer. The steel disk has a large mass and thus a high inertia.

Document U.S. Pat. No. 4,150,955 A is concerned with a polishing wheel made from soft polyurethane foam. Here, the abrasive particles are embedded in the soft polyurethane foam and can break free very easily. The durability of the grinding wheel is extremely limited, and the quantity of material which is removed is very low.

Document U.S. Pat. No. 2,173,462 A is concerned with a conventional grinding wheel without a hole that is fastened to a tool carrier via a rubber layer. This is once again a rigid disk with a great mass.

Document U.S. Pat. No. 8,366,521 B2 is a complex proposal for fastening diamond sintered bodies to a plastic matrix by means of a wire mesh. The disk is also very rigid and, moreover, expensive to produce.

Documents US 2002/0190737 A1 and US 2002/0028641 A1 describe elastic cleaning films with an abrasive layer for stylus tips during the production of semiconductor chips. The films are arranged on a wafer table and are moved over the stylus tips by way of the table drive. If abrasive particles are used on the films, they are bonded by a binding material layer comprising plastic. Document DE 600 00 673 T2 describes an annular finishing tool for polishing optical surfaces. The finishing tool is arranged in a rigid carrier and has an elastically deformable core and an annular layer 12B, the annular layer being deformable to a lesser extent than the core.

All grinding wheels having elastic abundant damping elements can reduce the shocks and vibrations which occur during the grinding operation to a certain extent. The result, however, is still not been satisfactory.

Accordingly, it is desirable to provide a simple and uncomplicated grinding wheel using very hard abrasive particles, where the grinding wheel has a high service life with a very high removal rate, and makes a low-vibration grinding operation possible.

SUMMARY OF THE INVENTION

According to the system described herein, a surface of a grinding wheel includes of an elastically deformable metal foil which is fastened directly on an elastomeric deformable supporting layer.

In other words, the abrasive particles are applied to the surface of a flexible metal foil by way of a galvanic bond, usually a nickel bond, out of which the abrasive particles protrude by from 30% to 50%. The metal foil is for its part fastened, in particular adhesively bonded fixedly, on an elastomerically deformable supporting layer. The metal foil can in practice be a steel foil, in particular a stainless steel foil. In this way, the grinding wheel is given a hard, but elastically deformable metal surface, to which extremely hard abrasive particles are fastened permanently. The metal foil can in practice have a thickness of less than 1 mm or 1000 μm. Metal foils having a thickness in the range from 200 μm to 700 μm have proven themselves in practical embodiments.

The metal foil is fastened directly on an elastomerically deformable supporting layer. The elastomeric supporting layer can be foamed and can consist, for example, of polyurethane foam or polyethylene foam. A closed-pore polyethylene foam has proven itself in practice. Unfoamed synthetic material or rubber material can also be used for the supporting layer, however. The metal foil can in practice be adhesively bonded onto the elastomerically deformable supporting layer.

Unlike in the case of conventional grinding wheels, in which abrasive material such as corundum is bonded into a binder, grinding dust is scarcely produced during a grinding operation using the grinding wheel described herein. In the case of conventional grinding wheels, the grinding dust consists mainly of binders and grinding particles which have broken free. The abrasive particles of the grinding wheel described herein which are bonded galvanically on the metal surface do not as a rule break free. Only the chips of the ground material, copper in the case of welding electrodes, are produced during the grinding operation using the grinding wheel described herein. The otherwise customary extraction at the grinding station can be dispensed with in practice.

In practice, the abrasive particles can be bonded on the surface of the metal foil in a plurality of areas, between which regions without abrasive particles lie. It is customary, for example, to arrange diamond particles or particles made from cubic boron nitride CBN on the grinding surface in a honeycomb form or circular form. Webs or regions, on which no abrasive particles are arranged, are produced between the honeycomb areas or the circular areas. The chips which are removed can be transported away in the said webs or regions.

As has been mentioned, the elastomerically deformable supporting layer can consist of plastic foam, in particular polyurethane foam or polyethylene foam. It was mentioned at the outset that no high forces act on the grinding wheel, for example, during the grinding of welding electrodes. A relatively soft, elastically deformable polyurethane foam or polyethylene foam, onto which the annular or circular disk-shaped supporting layer is adhesively bonded, has a sufficiently great strength to be used durably for re-grinding welding electrodes. Since the thin metal foil is adhesively bonded directly onto the elastically deformable supporting layer, the surface of the grinding wheel with abrasive particles has a considerable elastic deformability at every point. The metal foil is deformable, as is the supporting layer which is situated underneath it. If the abrasive particles strike projections and unevennesses in the surface of the welding electrode during a tumbling movement of the grinding apparatus for grinding welding electrodes, the local elastic deformation of the metal foil and the supporting layer which lies underneath it leads to considerable damping of the said shocks. The grinding operation is considerably quieter and freer from vibrations than if a solid metal disk with bonded diamond particles is used. On the other hand, the stability of the grinding wheel is comparable with a solid metal grinding wheel, on the surface of which diamond particles are bonded galvanically.

As an alternative, the elastomerically deformable supporting layer can be adhesively bonded onto a metallic supporting body. The grinding wheel is of circular configuration, a ring comprising metal foil preferably being adhesively bonded onto the elastic supporting layer both on the upper side and on the underside in the outer circumferential region of the grinding wheel. The metallic supporting body can form a plate-shaped core of the grinding wheel, which core fills the middle region of the thickness of the said grinding wheel. The core which extends, for example, over from 3 to 10 mm is adjoined by an elastomeric supporting layer. Onto the side of each supporting layer facing away from the core, the metal foil with the abrasive particles is adhesively bonded. In one embodiment, two elastomeric supporting layers comprising closed-pore polyethylene foam on the two sides of the supporting body with a thickness of in each case 1.6 mm have proven themselves.

As has been stated, elastically deformable supporting layers with metal foils which are adhesively bonded on the outer side are preferably attached on both sides of the metallic supporting body. Welding electrodes are usually arranged on welding guns which press them against one another. As the two opposite surfaces of the grinding wheel have a metal foil with abrasive particles, an open welding gun can be moved towards the grinding wheel and the first electrode can be moved against the first surface of the grinding wheel and the second electrode can be moved against the second surface of the grinding wheel.

As has been described above, it is not absolutely necessary to attach the metal foil over the entire circular surface of the grinding wheel. In practice, the elastically deformable metal foil can extend only over an outer annular region of the grinding wheel.

Furthermore, the system described herein relates to an apparatus for grinding solid workpieces having a grinding wheel of the above-described type, a bearing for rotatably mounting the grinding wheel about a rotational axis, and a grinding wheel drive which is coupled to the grinding wheel for rotating the grinding wheel. The bearing is fastened on a pivotable and displaceable bearing carrier, it being possible for the bearing plane of the bearing to be pivoted in relation to a starting plane and to be displaced in a starting direction which is perpendicular with respect to the starting plane. An apparatus for pivoting and displacing the bearing carrier causes the surface of the grinding wheel to produce a conical or curved area about a stationary reference point which is at a radial spacing from the center point of the grinding wheel. Apparatuses of this type, in which the grinding wheel which is described herein can be used for grinding welding electrodes, are described in documents DE 10 2012 215 532 A1 and DE 10 2014 203 409 A1.

BRIEF DESCRIPTION OF THE DRAWINGS

The system described herein will be shown in greater detail in the following text with reference to the drawings, which are as follows.

DETAILED DESCRIPTION OF VARIOUS EMBODIMENTS

Figure 1:
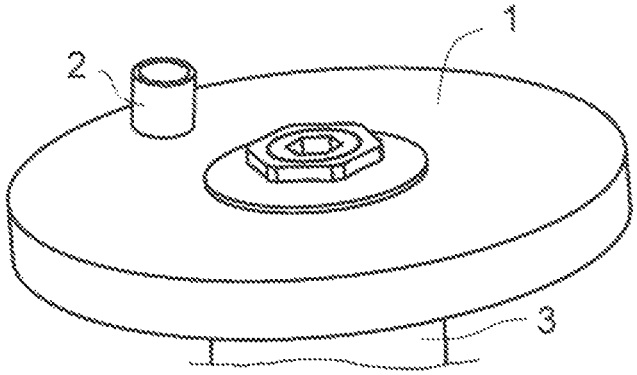
FIGS. 1 to 4 show a perspective illustration and three sectional illustrations of the grinding wheel and a workpiece of the grinding apparatus which is described herein.

FIGS. 1 to 4 show the grinding process which is aimed for using the grinding apparatuses which are described in documents DE 10 2012 215 532 A1 and DE 10 2014 203 409 A1 and is preferably to be carried out using the grinding wheel 1 which is described herein. The grinding wheel 1 and the workpiece 2 are depicted here. The grinding wheel 1 is of planar configuration, that is to say it has two grinding surfaces which are parallel to one another. In the illustration which is shown, the workpiece 2 is a welding electrode made from copper. The welding electrode 2 is shown in a free-standing manner. In practice, it is moved to the grinding wheel 1 by a welding gun which is fastened to a robot arm. The grinding wheel 1 preferably consists of an elastic, possibly foamed plastic material, on the disk-shaped upper side and lower side of which abrasive grinding materials are deposited. Rigid grinding wheels 1 may also be used, however. The grinding wheel 1 is screwed fixedly on a hub 3 which can be pivoted and displaced by the present grinding apparatus.

Figure 2:
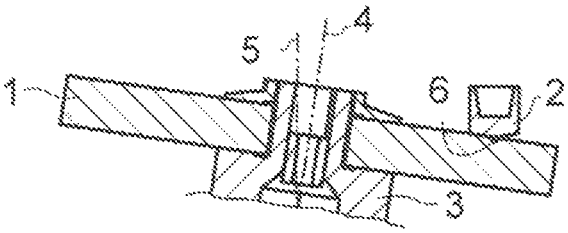
Figure 3:
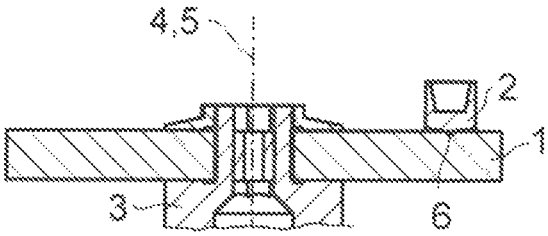
Figure 4:
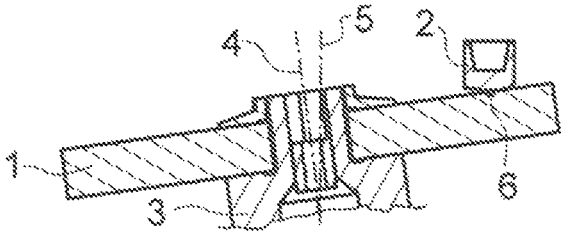

The rotational axis of the bearing of the grinding wheel is provided with the reference numeral 4 in FIGS. 2 to 4. The bearing itself is not shown.

The vertical direction, along which the grinding wheel 1 can be displaced, is provided with the reference numeral 5 in FIGS. 2 to 4. The vertical direction 5 in FIGS. 2 to 4 corresponds to the starting direction. It is noted that the starting direction can be selected to be in any desired position. The workpiece 2 is then to be moved in the corresponding position onto the grinding face of the grinding wheel 1. The relative position of the components of the grinding apparatus is pivoted correspondingly in the case of pivoting of the starting direction 5.

It can be gathered from FIGS. 2 and 3, in particular, that the rotational axis of the mounting of the grinding wheel 1 can be pivoted with respect to the vertical starting direction 5 in order to produce a rotationally symmetrical, convex surface on the workpiece 2. Here, the rotational axis 4 can be pivoted not only in the illustrated plane of FIGS. 2, 3 and 4, but rather also perpendicularly with respect thereto and in any desired other directions. The grinding wheel 1 is held in such a way that the rotational axis 4 can be pivoted freely around the starting direction 5 within a conical adjustment region. At the same time, the grinding wheel 1 can be displaced in the vertical starting direction 5. The pivoting movements and displacement movements are synchronized in such a way that the grinding wheel 1 is in contact with the surface of the workpiece 2 in the vicinity of a reference point 6. As a result of the pivotability of the grinding wheel 1, the grinding wheel 1 can produce a convexly formed, in particular spherical or conical surface on the end side of the workpiece 2. During the machining process, the workpiece 2 remains stationary in relation to the machine frame of the grinding apparatus, with the result that the reference point 6 is stationary.

The reference point 6 is at a radial spacing from the center point of the grinding wheel 1. Due to the radial spacing, the pivoting of the grinding wheel 1 causes a movement of the reference point 6 in the starting direction 5, which movement is compensated for by way of a displacement of the mounting of the grinding wheel 1. The displacement movement and the pivoting movement of the grinding wheel 1 are synchronized in such a way that the surface of the grinding wheel 1 always makes contact with the workpiece 2 in the vicinity of the reference point 6. A tumbling movement of the grinding wheel 1 can thus be produced, which tumbling movement produces a convex surface on the end side of the workpiece 2 in the region of the reference point 6.

The surface of the workpiece 2 does not necessarily have to be ground in a rotationally symmetrical manner. Any desired forms of the end side of the workpiece 2 in the pivoting range and displacement range of the grinding wheel 1 can be realized by way of the free pivoting and displacement of the grinding wheel 1.

Figure 5:
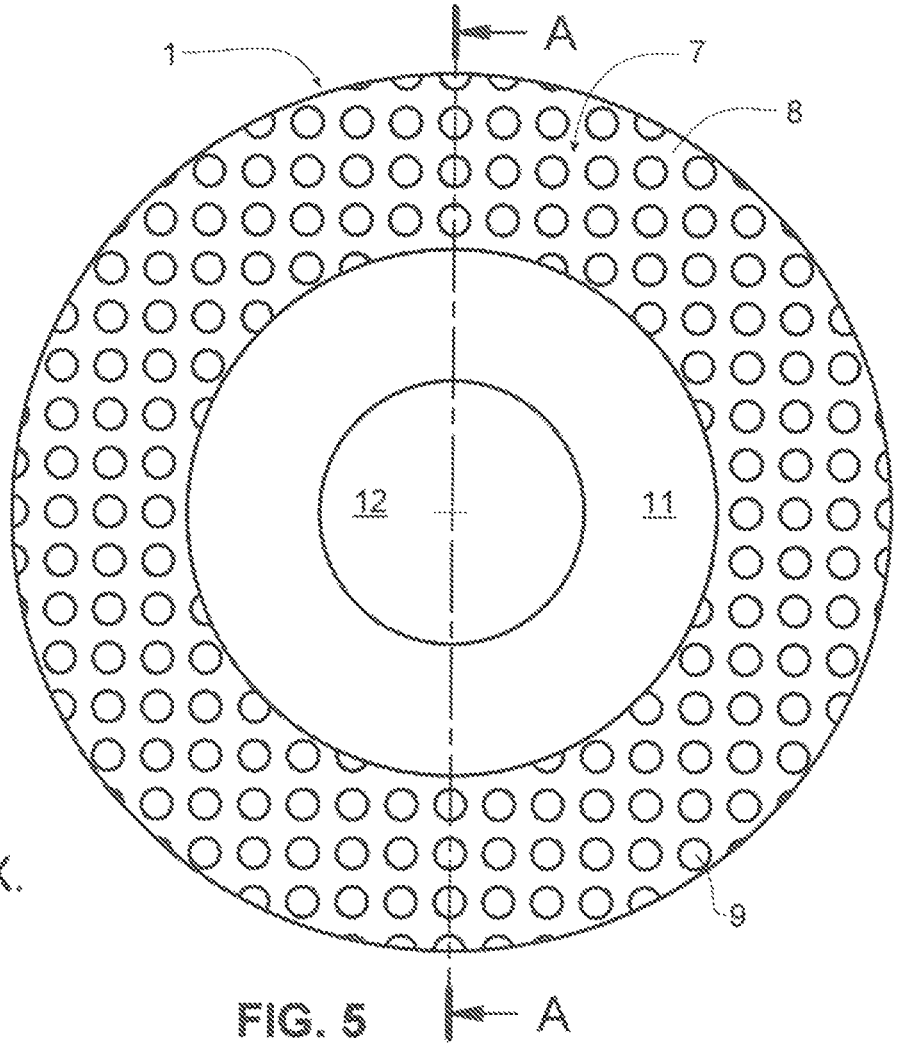
FIG. 5 shows a plan view of a first embodiment of the grinding wheel which is described herein.

FIG. 5 shows a plan view of a first embodiment of a grinding wheel 1 of the type described herein. The grinding wheel 1 has a metal foil 8 in an annular outer region 7 which extends approximately over a third of the radius of the grinding wheel 1. The metal foil 8 can be seen on an enlarged scale in FIG. 7. Diamond particles 10 are bonded in circular areas 9 on the metal foil 8. The diamond particles are shown diagrammatically as triangular peaks in FIG. 7, although the contour of the edges of the diamond particles 10 differs in practice from a triangular contour. The bonding of the diamond particles 10 to the metal foil 8 takes place galvanically by way of nickel. Approximately 50% of the diamond particles protrude out of the nickel bond. It is also possible to bond other abrasive particles, for example cubic boron nitride CBN, galvanically on the metal foil 8.

The metal foil 8 is adhesively bonded on a middle, elastomeric supporting layer 11 comprising a closed-pore polyethylene foam. An opening 12 is situated in the center of the grinding wheel 1. The opening 12 serves to fasten the grinding wheel 1 to the hub 3 (see FIGS. 1-4).

On account of the elastomeric polyethylene foam, the metallic surface of the grinding wheel 1, which metallic surface is formed by way of the metal foil 8, can deflect flexibly at every location. The metal foil 8 is deformable to a certain extent. Hard shocks or jolts are cushioned on the surface of the grinding wheel 1 as a result of the deflection of the metal foil 8 with the diamond particles 10 which is adhesively bonded on the elastomeric supporting layer 11.

The grinding wheel 1 is provided for the purpose of machining welding electrodes 2 made from copper. After a few welding operations, the welding electrodes 2 have to be re-ground. Since no great quantities of material have to be removed, the corresponding forces on the grinding wheel 1 are only small and can be introduced directly into the hub 3 via the elastomeric supporting layer 11.

As an alternative to the embodiment from FIGS. 5 to 7, FIGS. 8 to 10 show a version of the grinding wheel 1', in which a supporting body 13 made from aluminum extends in the center of the grinding wheel 1' between its two surfaces. The supporting body forms a core of the grinding wheel 1'. One thin, elastomeric supporting layer 11' is applied on each of the two outer sides of the metallic supporting body 13 in the annular region 7, in which the metal foil 8 is arranged. The thin elastomeric supporting layer 11' also consists of closed-pore polyethylene foam. It extends on each side of the metallic supporting body 13 over a thickness of from approximately 1 mm to 2 mm. The flexibility of the thin elastomeric supporting layer 11' is sufficient, in order to effectively absorb shocks which act on the surface of the grinding wheel 1' with the diamond particles 10 during the machining.

Figure 6:
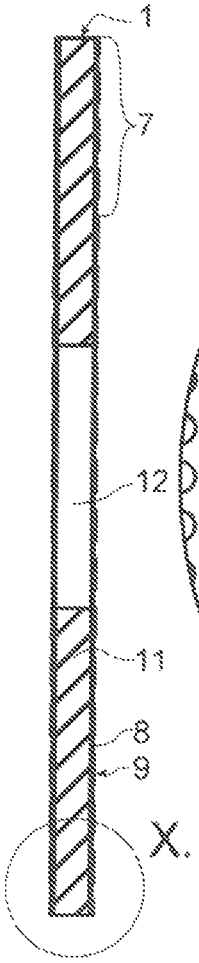
FIG. 6 shows an illustration of the grinding wheel from FIG. 5, which illustration is sectioned along the sectional line A-A.
Figure 7:
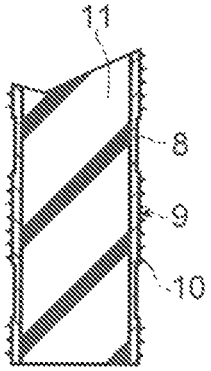
FIG. 7 shows the enlarged detail X from FIG. 6.
Figure 9:
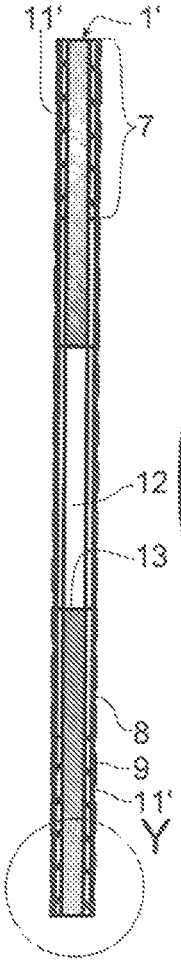
FIG. 9 shows an illustration of the grinding wheel from FIG. 8, which illustration is sectioned along the sectional line B-B.
Figure 8:
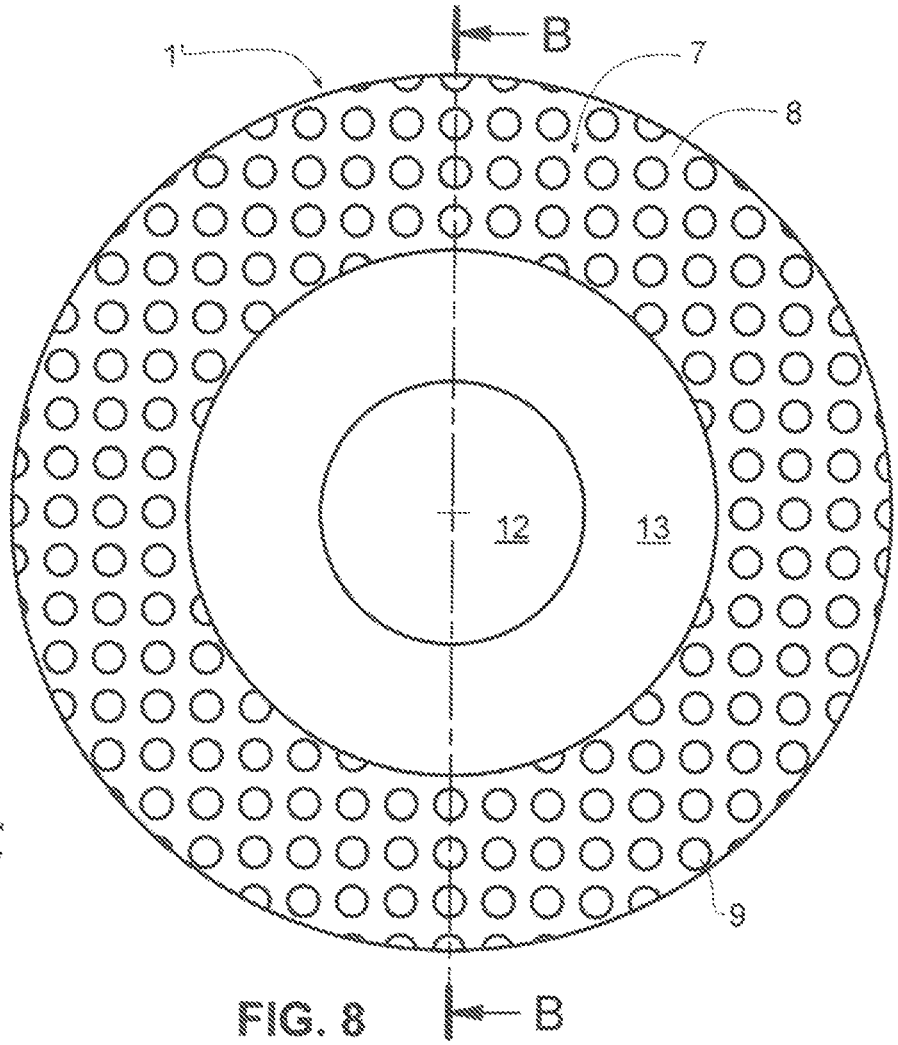
FIG. 8 shows a plan view of a second embodiment of the grinding wheel which is described herein.
Figure 10:
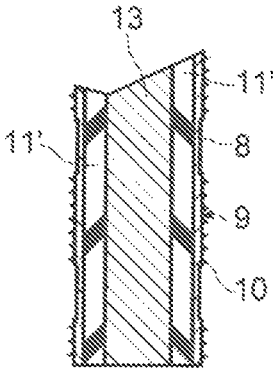
FIG. 10 shows the enlarged detail Y from FIG. 9.

In FIGS. 8 to 10, parts which are identical to the embodiment of the grinding wheel 1 from FIGS. 5 to 7 are identified by identical reference numerals.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A grinding wheel for grinding metallic welding electrodes, comprising:

an elastomerically deformable supporting layer that extends uninterrupted over an entire outer annular region of the grinding wheel from at least an inner edge of the outer annular region to an outer edge of the outer annular region;

a first metallic surface fastened to the elastomerically deformable supporting layer, the first metallic surface being an elastically deformable metal foil, wherein the elastically deformable metal foil extends radially, uninterrupted over the entire outer annular region along a surface of the elastomerically deformable supporting layer, from the inner edge of the outer annular region to the outer edge of the outer annular region such that the elastically deformable metal foil completely covers the outer annular region so that no portion of the surface of the elastomerically deformable supporting layer within the outer annular region is exposed; and abrasive particles attached to the first metallic surface.

2. The grinding wheel of claim 1, wherein the particles include at least one of: cubic boron nitride or diamonds.

3. The grinding wheel of claim 1, wherein the metal foil has a thickness of less than 1 mm.

4. The grinding wheel of claim 1, wherein the abrasive particles are bonded galvanically on the metallic surface.

5. The grinding wheel of claim 1, wherein the abrasive particles are bonded on the first metallic surface in a plurality of areas, wherein each of the plurality of areas is separated from the other of the plurality of areas by regions on the first metallic surface not having abrasive particles.

6. The grinding wheel of claim 1, wherein the metal foil is adhesively bonded onto the elastomerically deformable supporting layer.

7. The grinding wheel of claim 1, wherein the elastomerically deformable supporting layer is plastic foam.

8. The grinding wheel of claim 1, wherein, on an opposite side of the elastomerically deformable supporting layer from the first metallic surface, the elastomerically deformable supporting layer is adhesively bonded directly on to a metallic supporting body.

9. The grinding wheel of claim 1, further comprising:

a second metallic surface fastened to an elastomerically deformable supporting layer, the second metallic surface being opposite to the first metallic surface and having abrasive particles attached thereto.

10. The grinding wheel of claim 9, wherein the particles attached to the second metallic surface include at least one of: cubic boron nitride or diamonds.

11. The grinding wheel of claim 1, wherein the elastically deformable metal foil is substantially planar while fastened to the elastomerically deformable supporting layer.

12. An apparatus for grinding rigid, metallic welding electrodes for resistance welding, the apparatus comprising:

a grinding wheel having at least one elastomerically deformable supporting layer that extends uninterrupted over an entire outer annular region of the grinding wheel from at least an inner edge of the outer annular region to an outer edge of the outer annular region, a first metallic surface fastened to the elastomerically deformable supporting layer, the first metallic surface being an elastically deformable metal foil, wherein the elastically deformable metal foil extends radially, uninterrupted over the entire outer annular region along a surface of the elastomerically deformable supporting layer, from the inner edge of the outer annular region to the outer edge of the outer annular region such that the elastically deformable metal foil completely covers the outer annular region so that no portion of the surface of the elastomerically deformable supporting layer within the outer annular region is exposed, and abrasive particles attached to the first metallic surface;

a bearing, fastened on a pivotable and displaceable bearing carrier, for rotatably mounting the grinding wheel about a rotational axis;

a grinding wheel drive which is coupled to the grinding wheel to rotate the grinding wheel, wherein a bearing plane of the bearing is pivoted in relation to a starting plane and is displaced in a starting direction which is perpendicular with respect to the starting plane; and an apparatus for pivoting and displacing the bearing carrier, coupled to the bearing carrier, that causes the surface of the grinding wheel to produce a curved surface about a stationary reference point which is at a radial spacing from a center point of the grinding wheel.

13. The apparatus of claim 12, wherein the particles include at least one of: cubic boron nitride or diamonds.

14. The apparatus of claim 12, wherein the metal foil has a thickness of less than 1 mm.

15. The apparatus of claim 12, wherein the abrasive particles are bonded galvanically on the metallic surface.

16. The apparatus of claim 12, wherein the abrasive particles are bonded on the first metallic surface in a plurality of areas, wherein each of the plurality of areas is separated from the other of the plurality of areas by regions on the first metallic surface not having abrasive particles.

17. The apparatus of claim 12, wherein the metal foil is adhesively bonded onto the elastomerically deformable supporting layer.

18. The apparatus of claim 12, wherein the elastomerically deformable supporting layer is plastic foam.

19. The apparatus of claim 12, wherein, on an opposite side of the elastomerically deformable supporting layer from the first metallic surface, the elastomerically deformable supporting layer is adhesively bonded directly on to a metallic supporting body.

20. The apparatus of claim 12, wherein the grinding wheel further comprises:

a second metallic surface fastened to an elastomerically deformable supporting layer, the second metallic surface being opposite to the first metallic surface and having abrasive particles attached thereto.

21. The apparatus of claim 10, wherein the particles attached to the second metallic surface include at least one of: cubic boron nitride or diamonds.

22. The apparatus of claim 12, wherein the elastically deformable metal foil is substantially planar while fastened to the elastomerically deformable supporting layer.

* * * * *